US007921682B1

(12) United States Patent
Chang

(10) Patent No.: US 7,921,682 B1
(45) Date of Patent: Apr. 12, 2011

(54) PADLOCK WITH ALARM FUNCTION

(76) Inventor: Jieh-Jung Chang, Sanxia Township (TW)

( * ) Notice: Subject to any disclaimer, the term of this patent is extended or adjusted under 35 U.S.C. 154(b) by 0 days.

(21) Appl. No.: 12/638,637

(22) Filed: Dec. 15, 2009

(51) Int. Cl.
*E05B 67/24* (2006.01)

(52) U.S. Cl. ..... 70/38 A; 70/52; 70/53; 70/276; 70/370; 70/439; 70/DIG. 49; 340/542

(58) Field of Classification Search ..... 70/DIG. 30, 70/DIG. 49, 276, 53, 370, 49, 38 R, 437, 70/439, 20, 38 A, 38 B, 38 C, 50, 51, 52; 340/542, 426.28, 571, 572.9, 5.73
See application file for complete search history.

(56) References Cited

U.S. PATENT DOCUMENTS

| | | | | |
|---|---|---|---|---|
| 3,934,437 | A * | 1/1976 | Crepinsek | 70/370 |
| 3,993,987 | A * | 11/1976 | Stevens | 340/542 |
| 4,811,578 | A * | 3/1989 | Masoncup et al. | 70/38 B |
| 5,181,403 | A * | 1/1993 | Lii | 70/38 C |
| 5,404,735 | A * | 4/1995 | Hsieh | 70/38 A |
| 5,406,257 | A * | 4/1995 | Saito | 340/542 |
| 5,507,160 | A * | 4/1996 | Shieh | 70/233 |
| 5,587,702 | A * | 12/1996 | Chadfield | 340/542 |
| 5,598,725 | A * | 2/1997 | Chang | 70/209 |
| 5,598,727 | A * | 2/1997 | White | 70/233 |
| 5,727,405 | A * | 3/1998 | Cromwell | 70/38 B |
| 5,783,996 | A * | 7/1998 | Muszynski | 340/571 |
| 5,786,759 | A * | 7/1998 | Ling | 340/542 |
| 5,856,782 | A * | 1/1999 | Sasagawa et al. | 340/572.9 |
| 5,889,463 | A * | 3/1999 | Judd et al. | 340/427 |
| 5,920,254 | A * | 7/1999 | Hsieh | 340/426.31 |
| 6,177,869 | B1 * | 1/2001 | McDaid | 340/568.1 |
| 6,357,265 | B1 * | 3/2002 | Chang | 70/25 |
| 6,523,379 | B2 * | 2/2003 | Teskey | 70/371 |
| 6,550,295 | B2 * | 4/2003 | Hubner | 70/208 |
| 7,382,250 | B2 * | 6/2008 | Marcelle et al. | 340/542 |
| 2001/0022097 | A1 * | 9/2001 | Bremicker | 70/38 R |
| 2008/0036596 | A1 * | 2/2008 | Auerbach et al. | 340/542 |
| 2008/0256991 | A1 * | 10/2008 | Goldman | 70/57.1 |

* cited by examiner

*Primary Examiner* — Lloyd A Gall
(74) *Attorney, Agent, or Firm* — Jackson IPG PLLC; Demian K. Jackson

(57) ABSTRACT

A padlock includes a lock body, a lock shackle having two ends respectively inserted into a respective shackle hole in the lock body, two actuation members, two latches, a lock cylinder having a core inserted in between the actuation members and rotatable with a predetermined key to drive the actuation members in moving the latches to lock the lock shackle, and an alarm control device affixed to the lock body for causing a buzzer to buzz upon a vibration.

6 Claims, 6 Drawing Sheets

PADLOCK WITH ALARM FUNCTION

BACKGROUND OF THE INVENTION

1. Field of the Invention

The present invention relates to locks and more particularly, to a padlock, which provides a locking function as well as an alarm function and, which has a simple structure and a compact size.

2. Description of the Related Art

Pad locks are portable locks used to protect against theft and unauthorized use. When a padlock is used to lock a door, window or vehicle, a theft may directly destroy the padlock or the door, window or vehicle for entry. Because conventional padlocks simply provide a locking function, they cannot give an alarm signal upon a forced or surreptitious entry.

SUMMARY OF THE INVENTION

The present invention has been accomplished under the circumstances in view. It is one object of the present invention to provide a padlock, which provides a locking function as well as an alarm function. It is another object of the present invention to provide a padlock, which has the characteristics of simple structure and compact size, convenient for use.

To achieve these and other objects of the present invention, the padlock comprises a lock body, a lock shackle having two ends respectively inserted into a respective shackle hole in the lock body, two actuation members, two latches, a lock cylinder having a core inserted in between the actuation members and rotatable with a predetermined key to drive the actuation members in moving the latches to lock the lock shackle, and an alarm control device affixed to the lock body for causing a buzzer to buzz upon a vibration.

DETAILED DESCRIPTION OF THE INVENTION

Figure 1:
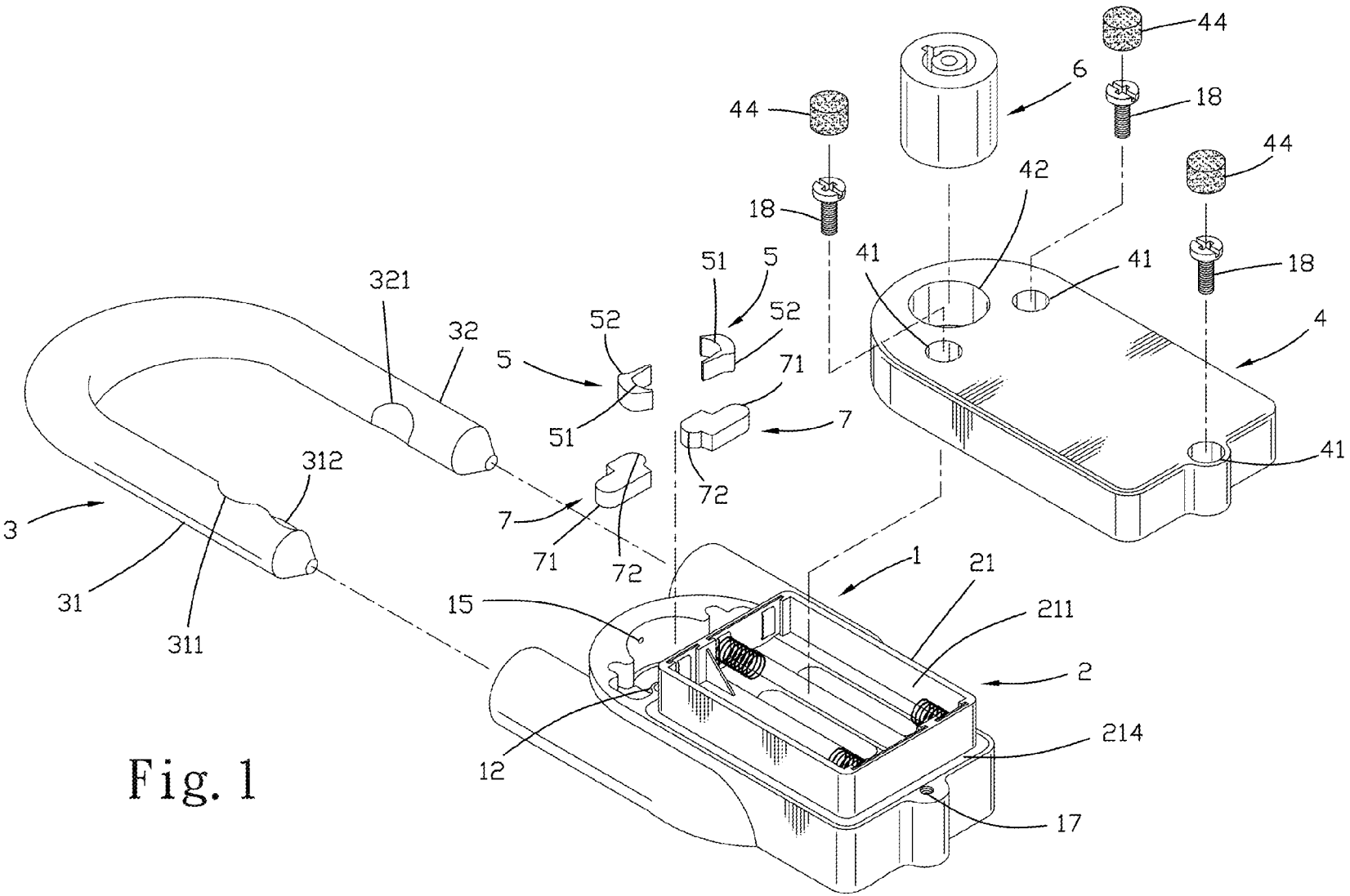
FIG. 1 is an exploded view of a padlock in accordance with the present invention.
Figure 2:
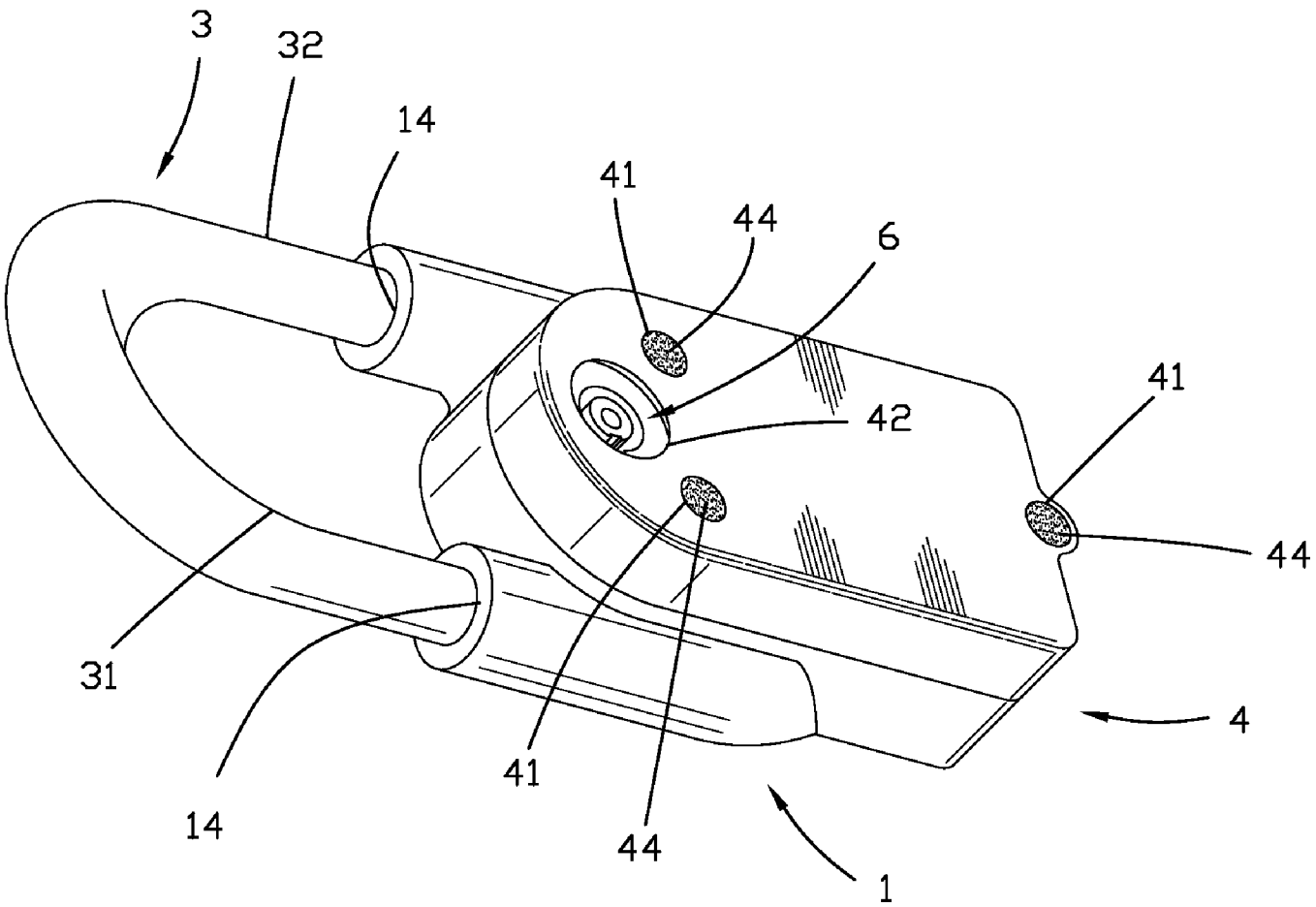
FIG. 2 is an elevational view of the padlock in accordance with the present invention.
Figure 3:
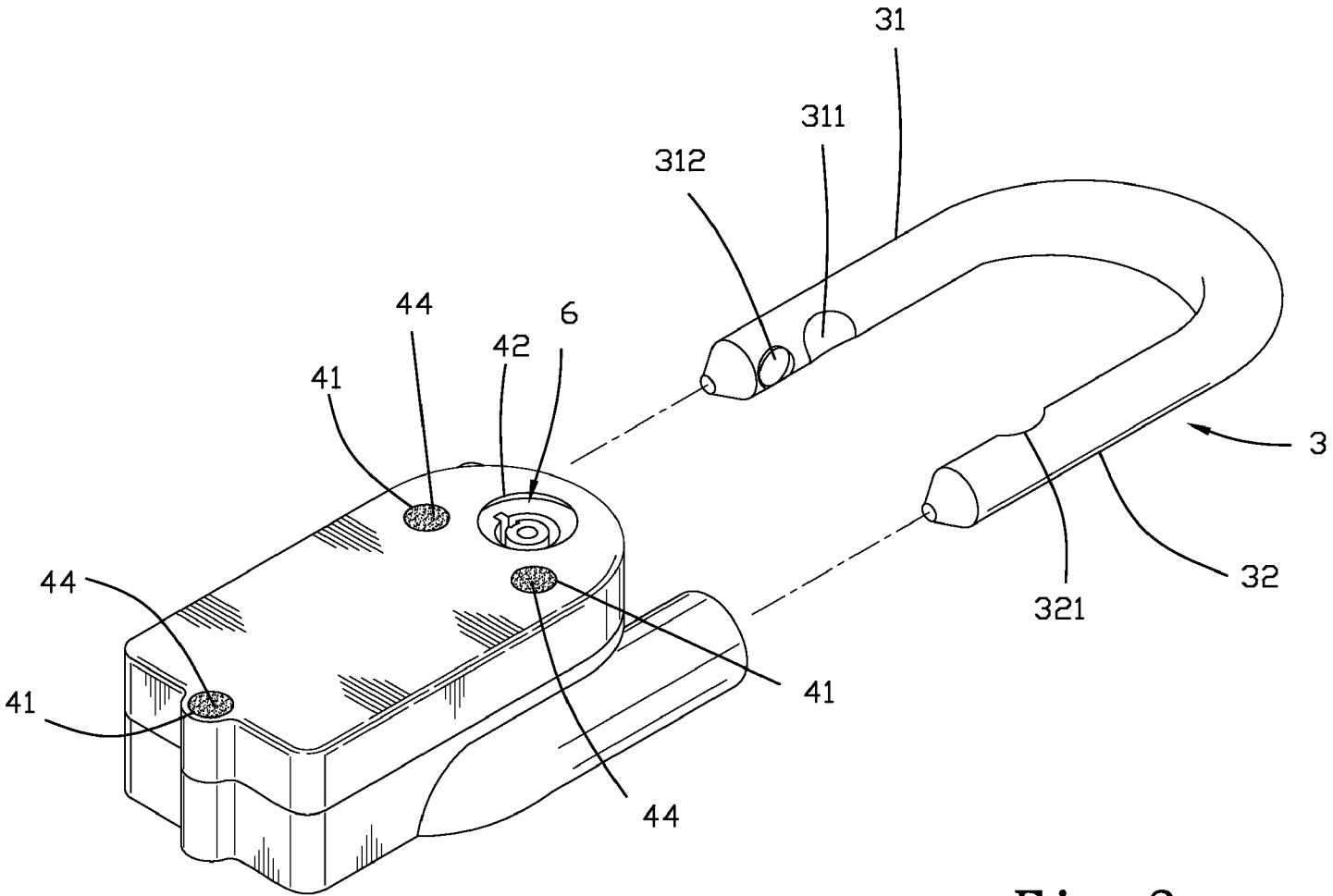
FIG. 3 corresponds to FIG. 2, showing the lock shackle removed from the lock body.
Figure 4:
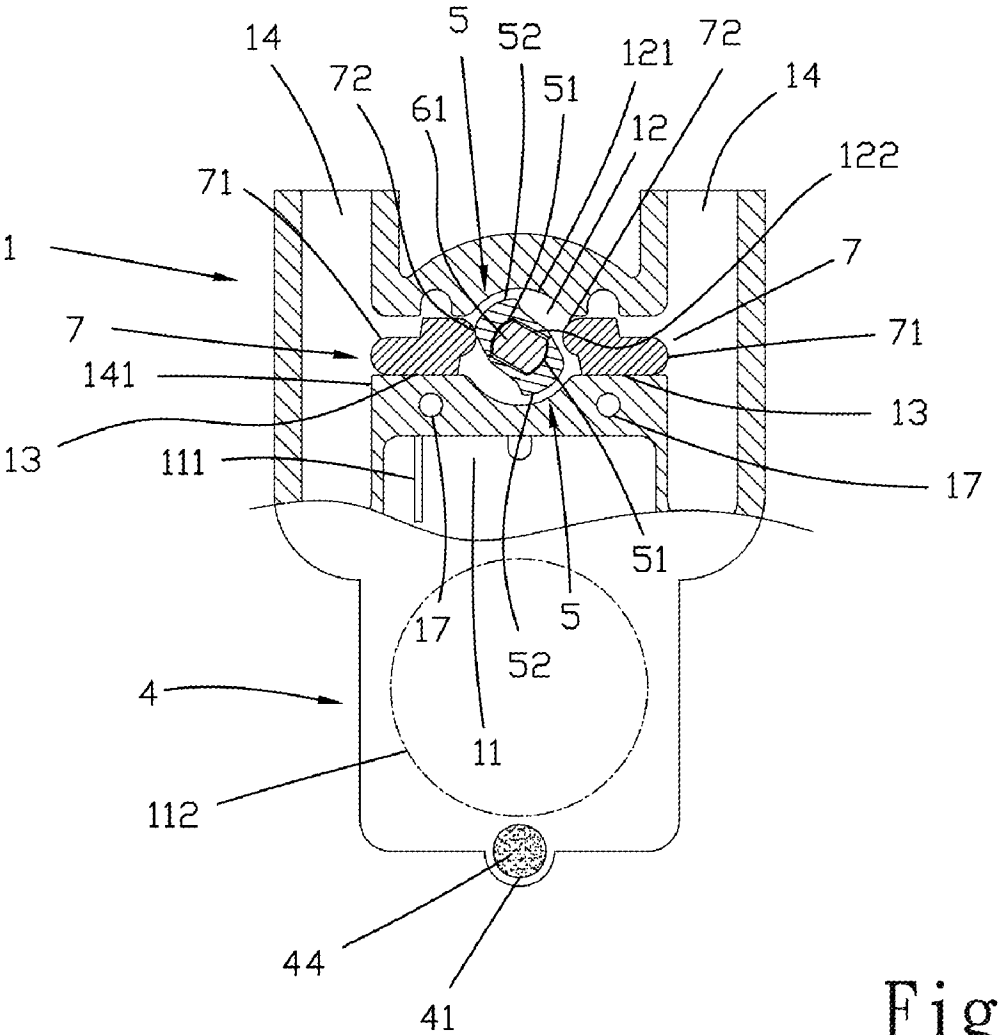
FIG. 4 is a schematic sectional view of the padlock according to the present invention after removal of the lock shackle.
Figure 5:
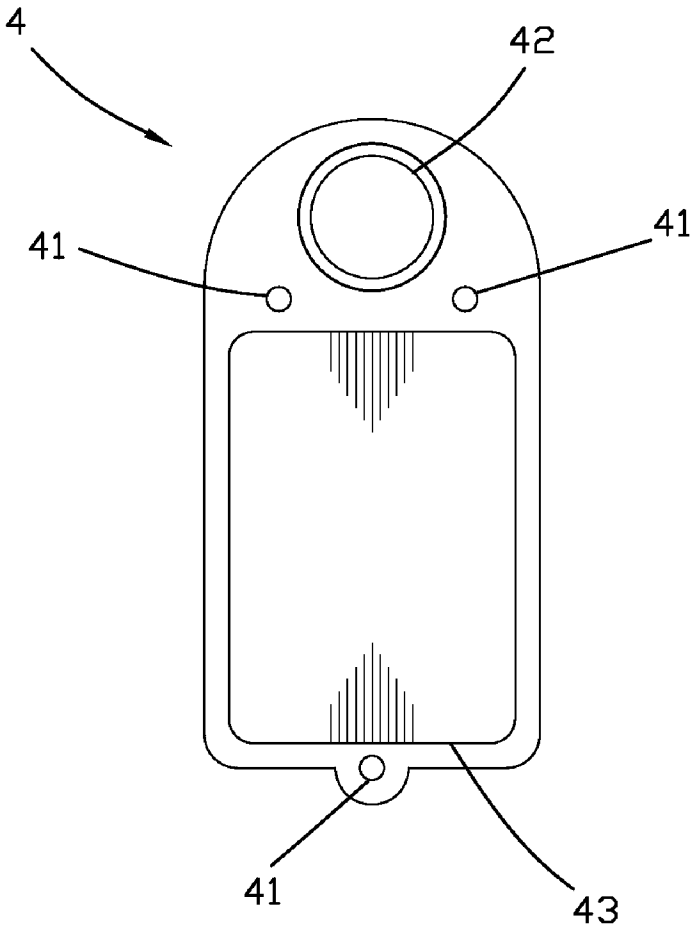
FIG. 5 is a bottom plan view of the cover plate according to the present invention.
Figure 6:
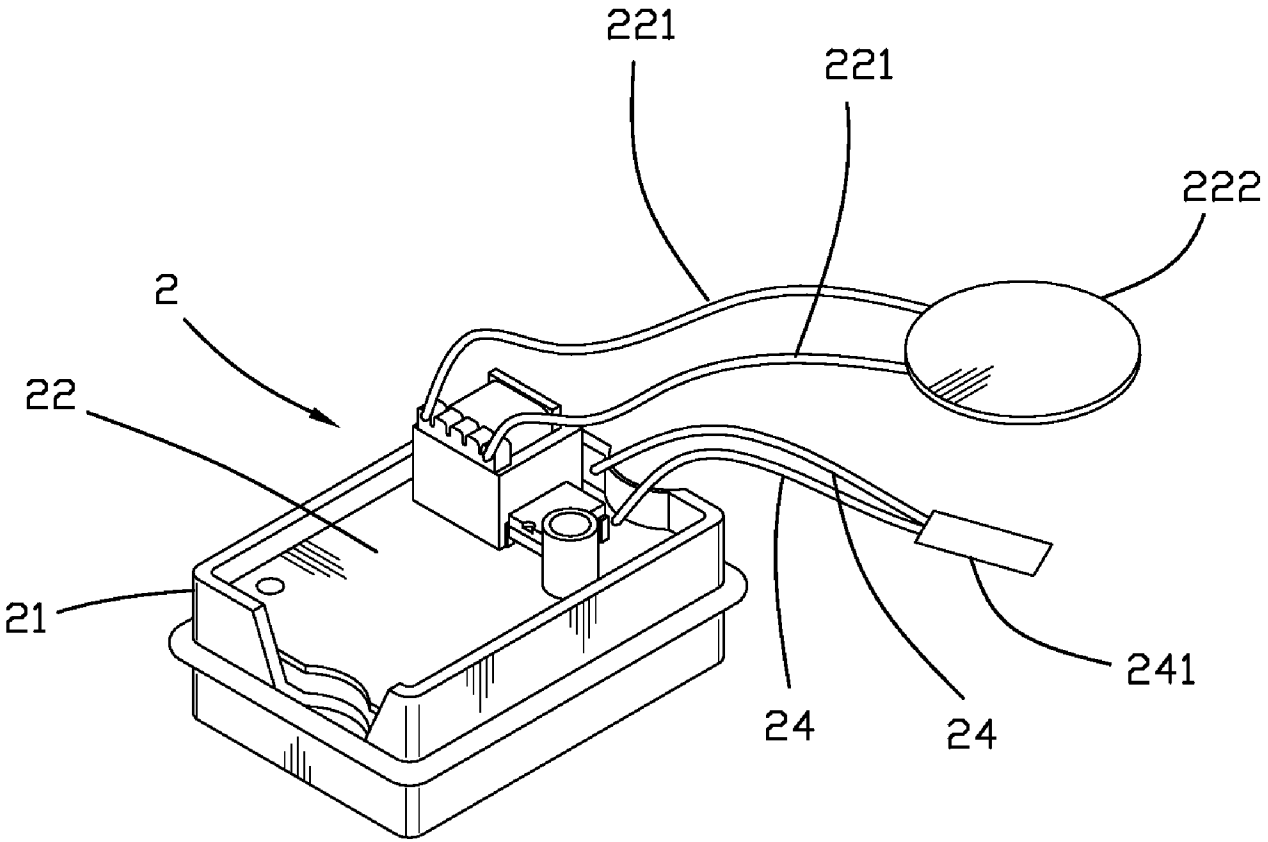
FIG. 6 is an elevational view of the alarm control device according to the present invention.

Referring to FIGS. 1~6, a padlock in accordance with the present invention is shown comprising a lock body 1, an alarm control device 2, a lock shackle 3, a cover plate 4, two actuation members 5, a lock cylinder 6, and two latches 7.

The lock body 1 comprises an accommodation chamber 11, which accommodates the alarm control device 2 (see FIG. 4), a lock chamber 12, which accommodates the actuation members 5 and the core 61 of the lock cylinder 6 in between the actuation members 5 (see FIG. 4), two shackle holes 14 arranged in parallel at two opposite lateral sides relative to the accommodation chamber 11 and the lock chamber 12, two sliding grooves 13, which extend transversely between the lock chamber 12 and the two shackle holes 14 and accommodate the latches 7 respectively, a plurality of first mounting holes 15 respectively disposed in the lock chamber 12 for the mounting of fastening members (not shown) to fixedly fasten the lock cylinder 6 to the inside of the lock chamber 12, and a plurality of second mounting holes 17 for the mounting of screws 18 to affix the cover plate 4 to the lock body 1. Further, each latch 7 has one end, namely, the front end 71 inserted into one shackle hole 14, and the other end, namely, the rear end 72 abutted against the associating actuation member 5.

The alarm control device 2 comprises a housing 21 having a battery chamber 211 that accommodates a set of battery cells (not shown), and an alarm circuit board 22 mounted inside the housing 21. The alarm circuit board 22 comprises a vibration sensor (not shown), and a buzzer 222 controllable by the vibration sensor to output an audio alarm signal. Because the alarm circuit board 22 is of the known art, no further detailed description in this regard is necessary.

The lock shackle 3 is a U-bar having a first end 31, a second end 32, a first retaining groove 311 located on the periphery of the first end 31 at an inner side, and a second retaining groove 321 located on the periphery of the second end 32 at an inner side. The first end 31 and the second end 32 are respectively inserted into the shackle holes 14 of the lock body 1. When a user inserts the key into the lock cylinder 6 to rotate the core 61, the actuation members 5 are driven by the core 61 to move the latches 7, forcing the front ends 71 into the shackle holes 14.

The cover plate 4 comprises a plurality of mounting through holes 41 respectively fastened to the second mounting holes 17 of the lock body 1 by the mounting of screws 18 and then sealed with a respective water seal 44, a cylinder hole 42, which receives the lock cylinder 6, and a bottom chamber 43 fitting over the battery chamber 211 of the housing 21 of the alarm control device 2.

After insertion of the first end 31 and second end 32 of the lock shackle 3 into the shackle holes 14 of the lock body 1, a user can insert the key into the lock cylinder 6 to rotate the core 61 in moving the latches 7 between the locking position and the unlocking position. When the latches 7 are in the locking position, the front ends 71 of the latches 7 are respectively forced into engagement with the first retaining groove 311 and second retaining groove 321 of the lock shackle 3, thereby locking the shackle 3 to the lock body 1. In case of a forced or surreptitious entry after locking of the padlock, the padlock will be vibrated. At this time, the vibration sensor will drive the buzzer 222 to buzz. Further, when the latches 7 are in the unlocking position, the front ends 71 of the latches 7 are respectively kept away from the first retaining groove 311 and second retaining groove 321 of the lock shackle 3, thereby unlocking the shackle 3 from the lock body 1.

Further, a magnet 312 is fixedly mounted on the first end 31 of the lock shackle 3. The alarm circuit board 22 further comprises an arm/disarm control circuit (not shown) having connected thereto switching wires 24 with an induction terminal 241. The induction terminal 241 of the switching wires 24 is affixed to one side 111 of the accommodation chamber 11 of the lock body 1 adjacent to the inner side 141 of one shackle hole 14 (see FIG. 4). When the first end 31 of the lock shackle 3 is inserted into this shackle hole 14, the magnet 312 induces the induction terminal 241 of the switching wires 24, thereby causing the switching wires 24 to switch on the control circuit of the alarm control device 2, and therefore the alarm control device 2 is the alert mode. On the contrary, when the second end 32 of the lock shackle 3 is inserted into this shackle hole 14, the induction terminal 241 of the switching wires 24 is not induced, and the control circuit of the alarm device 2 is off, and therefore the alarm control device 2 is disarmed.

Further, the lock body 1 has a locating groove 112 in the accommodation chamber 11 for the positioning of the buzzer 222 of the alarm control device 2. The buzzer 222 is electrically connected to the vibration sensor at the alarm circuit board 22 by conductors 221.

Further, the lock chamber 12 of the lock body 1 is defined by two opposing semicircular walls 121. Each actuation member 5 has an arched notch 51 and a protruding portion 52. The arched notches 51 of the actuation members 5 define a space 122 for receiving the core 61 of the lock cylinder 6. The protruding portions 52 of the actuation members 5 are respectively abutted against the latches 7.

Further, the rear ends 72 of the latches 7 are protruded for the abutting of the protruding portions 52 of the actuation members 5 respectively.

Further, the housing 21 of the alarm control device 2 is covered with a gasket pad 214 to provide a water sealing effect after assembly of the cover plate 4 with the lock body 1.

In conclusion, the invention provides a padlock, which has the following features and advantages:

1. The padlock provides a locking function and an alarm function, and is practical for use to lock a vehicle, door or window. When a thief opens or removes the padlock or the vehicle, door or window, the alarm control device of the padlock buzzes.

2. The padlock has a simple structure and compact size, convenient for use and carrying.

3. A user can selectively switch on/off the alarm function.

4. The padlock provides an excellent waterproof function, well protecting the internal circuit against outside moisture.

5. The lock body can be made of zinc alloy, providing a high structural strength.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A padlock, comprising:

a lock body, said lock body comprising an accommodation chamber, a lock chamber, a first shackle hole and a second shackle hole arranged in parallel at two opposite lateral sides relative to said accommodation chamber and said lock chamber, two sliding grooves respectively transversely extended between two opposite lateral sides of said lock chamber and said first shackle hole and said second shackle hole, a plurality of first mounting holes respectively disposed in said lock chamber, and a plurality of second mounting holes;

two actuation members mounted in said lock chamber of said lock body, two latches respectively mounted in said sliding grooves and movable by said actuation members in and out of said first shackle hole and said second shackle hole;

a lock cylinder affixed to said first mounting holes of said lock body, said lock cylinder comprising a core rotatable by a predetermined key to drive said actuation members in moving said latches;

an alarm control device accommodated in said accommodation chamber of said lock body, said alarm control device comprising a housing having a battery chamber that accommodates a set of battery cells, and an alarm circuit board mounted inside said housing, said alarm circuit board comprising a buzzer to output an audio alarm signal;

a U-shaped lock shackle, said U-shaped lock shackle comprising a first end insertable into one of said first shackle hole and said second shackle hole, a second end insertable into one of said first shackle hole and said second shackle hole, a first retaining groove located on the periphery of said first end for the engagement of one said latch, and a second retaining groove located on the periphery of said second end for the engagement of one said latch; and a cover plate, said cover plate comprising a plurality of mounting through holes respectively fastened to said second mounting holes of said lock body with a respective fastening member and sealed with a respective water seal, a cylinder hole, which receives said lock cylinder, and a bottom chamber fitting over the battery chamber of said housing of said alarm control device.

2. The padlock as claimed in claim 1, wherein said lock shackle further comprises a magnet fixedly mounted on the first end thereof; said alarm circuit board further comprises a set of switching wires and an induction terminal at one end of said set of switching wires, said induction terminal being affixed to one side of said accommodation chamber of said lock body adjacent to said first shackle hole and inducible by said magnet to switch on said alarm control device into an alert mode upon insertion of the first end of said lock shackle into said first shackle hole.

3. The padlock as claimed in claim 1, wherein said lock body further comprises a locating groove disposed inside said accommodation chamber; said buzzer of said alarm control device is positioned in said locating groove in said accommodation chamber of said lock body and electrically connected to said alarm circuit board by conductors.

4. The padlock as claimed in claim 1, wherein said lock body comprises two opposing semicircular walls defining said lock chamber; each said actuation member comprises an arched notch, which receives the core of said lock cylinder, and a protruding portion abutted against one said latch.

5. The padlock as claimed in claim 4, wherein each said latch comprises a protruded rear end abutted against the protruding portion of one said actuation member.

6. The padlock as claimed in claim 1, wherein said alarm control device further comprises a gasket pad covering said housing.

* * * * *